US005799595A

United States Patent [19]

Michelbrink et al.

[11] Patent Number: 5,799,595

[45] Date of Patent: Sep. 1, 1998

[54] WET ASH REMOVER INSTALLATION

[75] Inventors: Bernhard Michelbrink; Karl Bleckmann, both of Wesel, Germany

[73] Assignee: Babcock Lentjes Kratwerkstechnik GmbH, Oberhausen, Germany

[21] Appl. No.: 712,361

[22] Filed: Sep. 11, 1996

[30] Foreign Application Priority Data

Sep. 20, 1995 [DE] Germany ..... 195 34 822.2

[51] Int. Cl.[6] ..... F23D 1/00

[52] U.S. Cl. ..... 110/266; 110/171; 110/167; 414/212

[58] Field of Search ..... 110/165 R, 166, 110/167, 259, 266, 171; 414/212; 126/242

[56] References Cited

U.S. PATENT DOCUMENTS

| | | | |
|---|---|---|---|
| 3,931,773 | 1/1976 | Reimann | 110/165 R |
| 4,227,468 | 10/1980 | Buchmuller et al. | 110/165 A X |
| 4,387,651 | 6/1983 | Moore | 110/166 X |
| 4,545,305 | 10/1985 | Howard et al. | 110/165 R |
| 4,790,250 | 12/1988 | Turner | 110/165 R X |
| 5,255,615 | 10/1993 | Magaldi | 110/259 X |

*Primary Examiner*—William E. Tapolcai
*Assistant Examiner*—Susanne Tinker
*Attorney, Agent, or Firm*—Max Fogiel

[57] ABSTRACT

A wet ash remover installation includes a first wet ash remover (5) which is placed in operating position under an ash funnel (2) of a boiler and a second, similar, movable wet ash remover (12) placed in reserve position. The wet ash removers (5, 12) respectively consist of a water-filled trough (7) which houses a conveying implement and in which a dip member (4) connected to the ash funnel (2) is immersed. Each trough (7) is provided in one of the side walls (13) and at the same height with an opening (14) extending to the upper edge of the side wall (13) and having a width which corresponds to at least the width of the dip member (4) and a height which corresponds to at least the maximum depth of immersion of the dip member (4) into the wet ash remover (5). The opening (14) is surrounded by a frame (17) supporting a compressible seal (19) and is closed by a rotatable gate (16) which engages the opening (14) from the inside. The openings (14) are positioned in the respectively opposing side walls (13) of the wet ash removers (5, 12) and the wet ash removers (5, 12) are provided with coupling elements.

7 Claims, 5 Drawing Sheets

WET ASH REMOVER INSTALLATION

Figure 1:
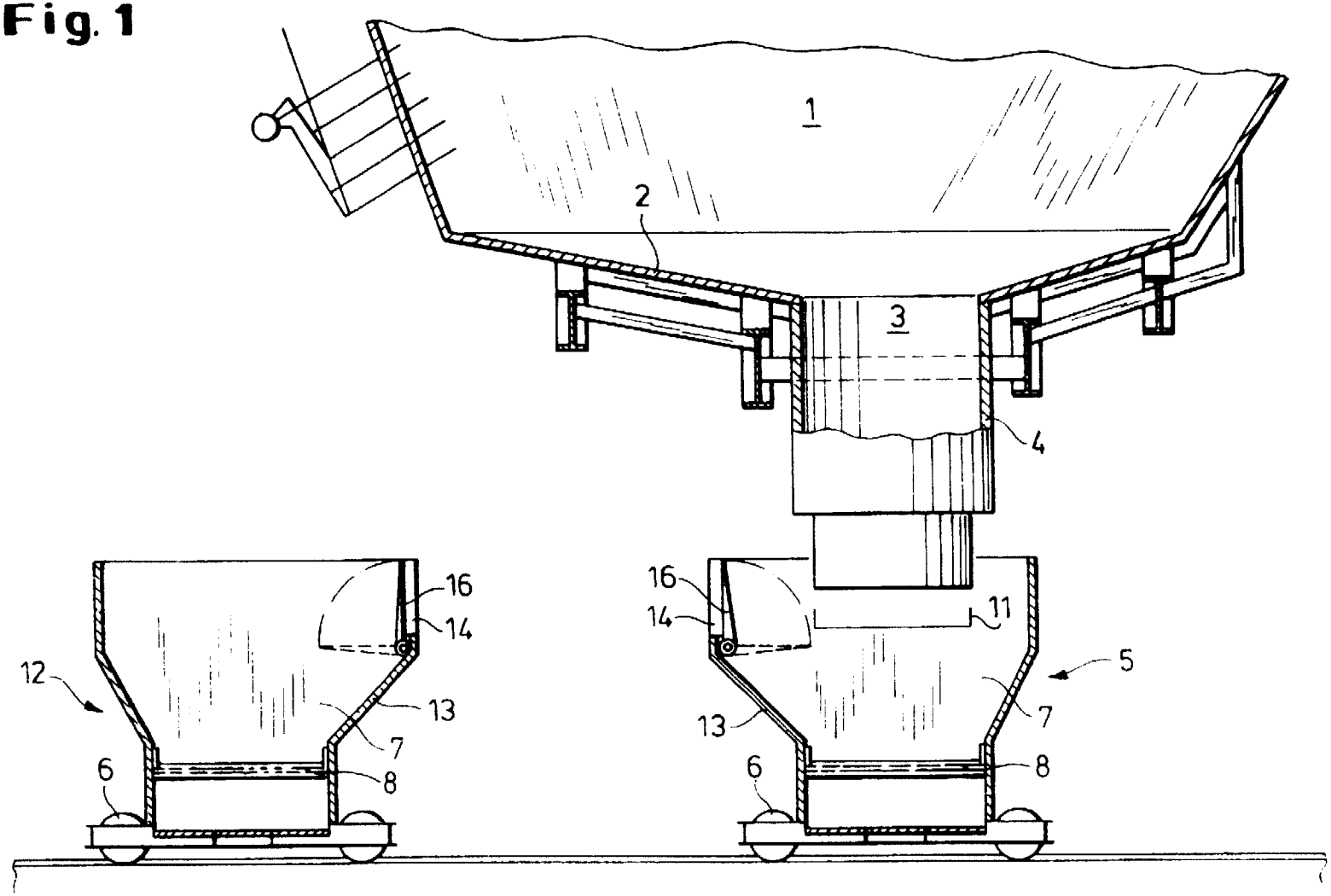

The invention relates to a wet ash remover installation with a first wet ash remover in operating position and a second similar and movable wet ash remover which is in reserve position, according to the features of the preamble of claim 1.

A known wet ash remover installation of this type (DE-PS 28 58 311) is positioned below a boiler with solid ash firing which is provided with a wide ash funnel. The movable wall portion of the ash remover consists of several plates which are connected to stationary supports because of the large funnel width. In this known arrangement, when the wet ash remover in operating position is to be moved, the water must be drained from the wet ash remover prior to loosening of the movable wall portion. The exchange of the wet ash remover itself is not possible without a short interruption of the boiler operation.

An exchange of the wet ash remover is possible in the wet ash remover arrangement of German Patent DE-PS 19 30 432. To this end, the ash funnel is telescopically constructed and attached to the boiler by way of a cylindrical arrangement for height adjustment. A plate rests on a holding arrangement of the water trough of the wet ash remover and is displaced in such a way that during the exchange operation, the shoot cross section of the raised ash funnel is closed. During this time, the ash accumulates in the fire chamber of the boiler. Such a process is only possible with dry ash firing whereby the ash is produced in solid form but not with molten ash firing and protection of ash in fluid form.

It is an object of the invention to construct a wet ash remover installation of this general type in such a way that a safe exchange of the wet ash remover is possible without interruption of the boiler operation even in connection with a molten ash firing.

In the wet ash remover installation of the invention, the operating ash remover and the reserve ash remover which are both filled with water can be coupled to be water tight. After the gates are lowered, they form a unit with a common water fill. This unit can be driven past and below the ash funnel without having to stop the firing during that time. After displacement of the unit, the gates of both wet ash removers are positioned upright again and the ash removers decoupled so that maintenance operations can be performed on the previously operating ash remover, while the ash remover previously in reserve receives the ash from the firing and cools and removes it.

Figure 2:
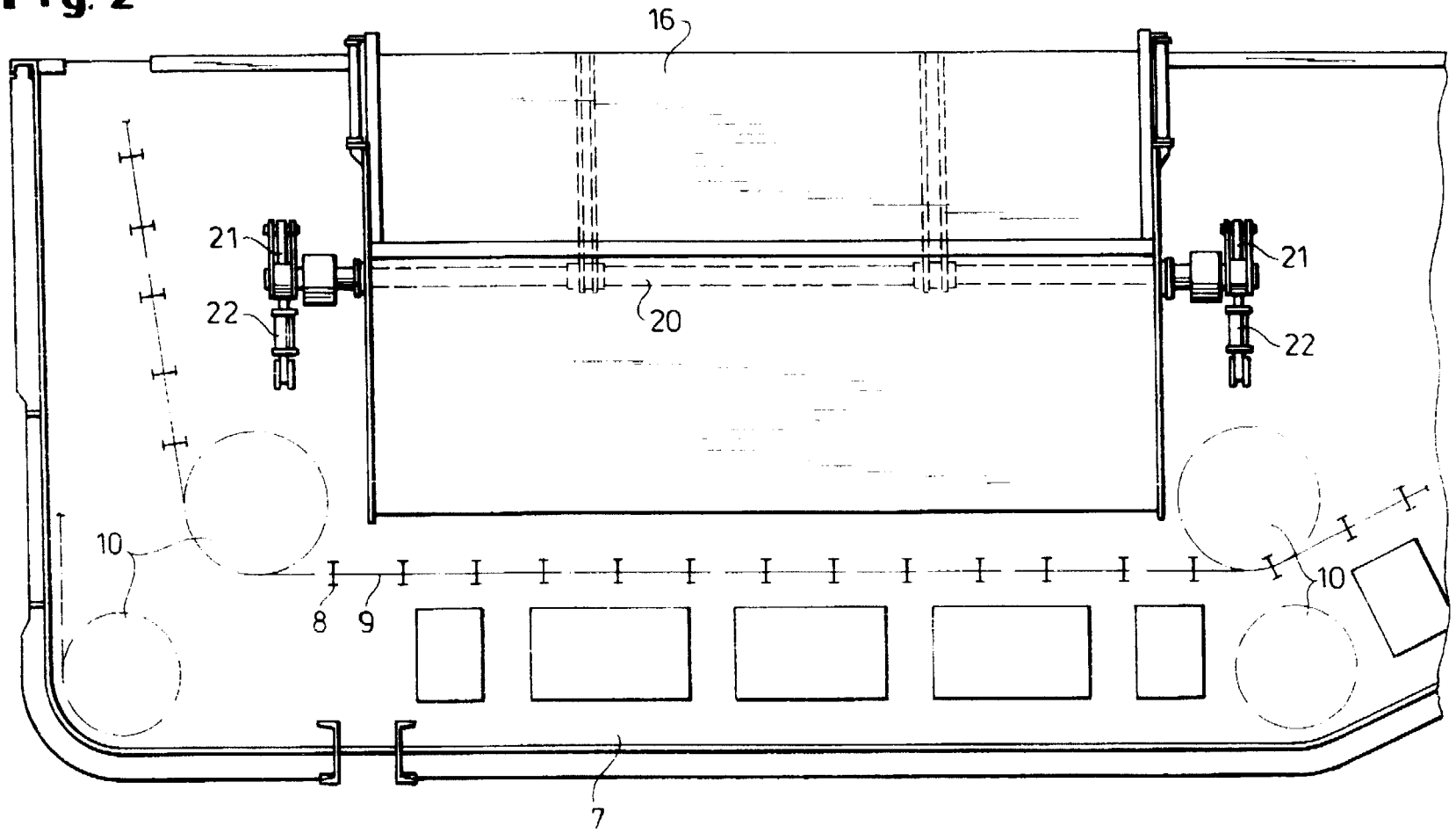
Figure 3:
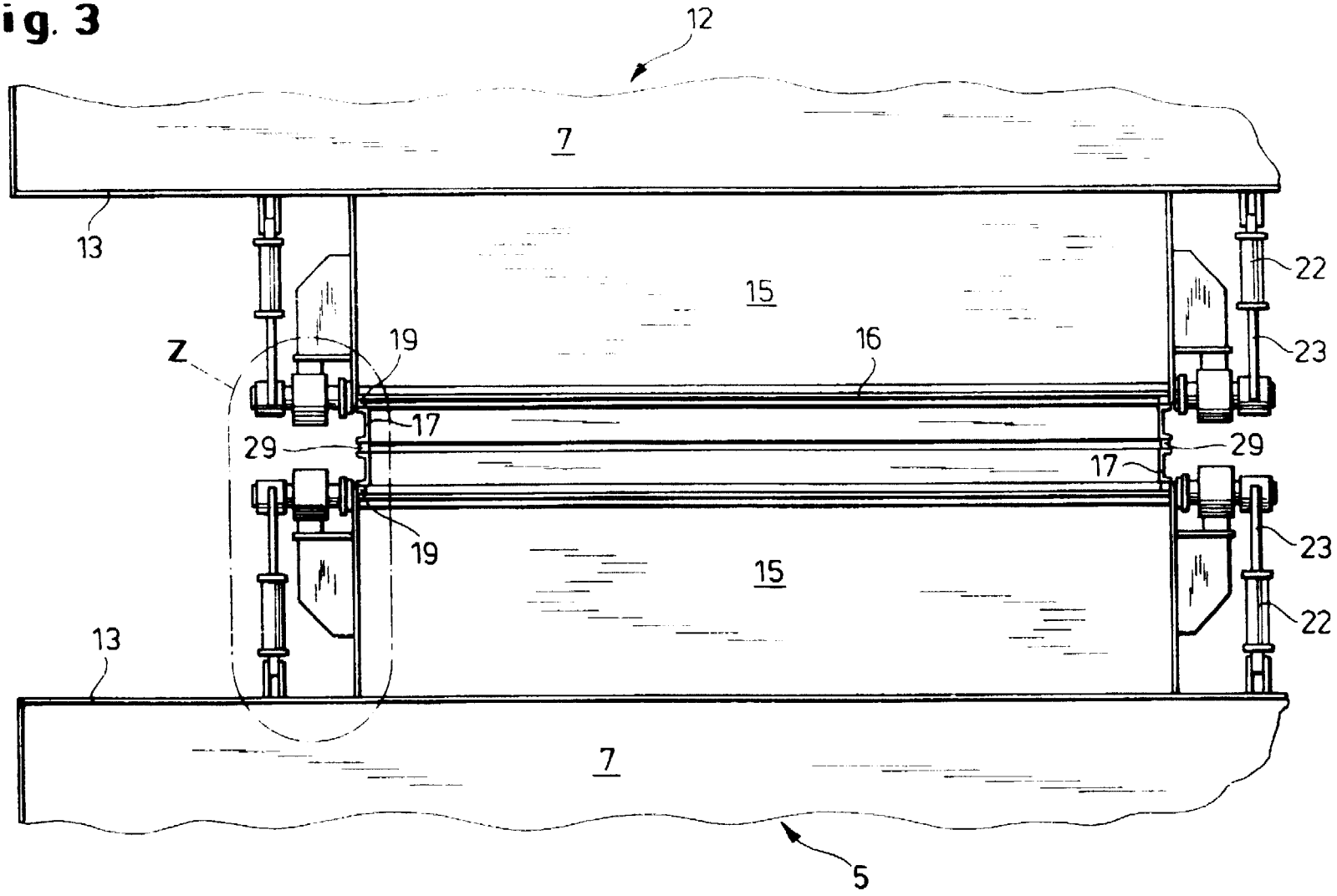
Figure 4:
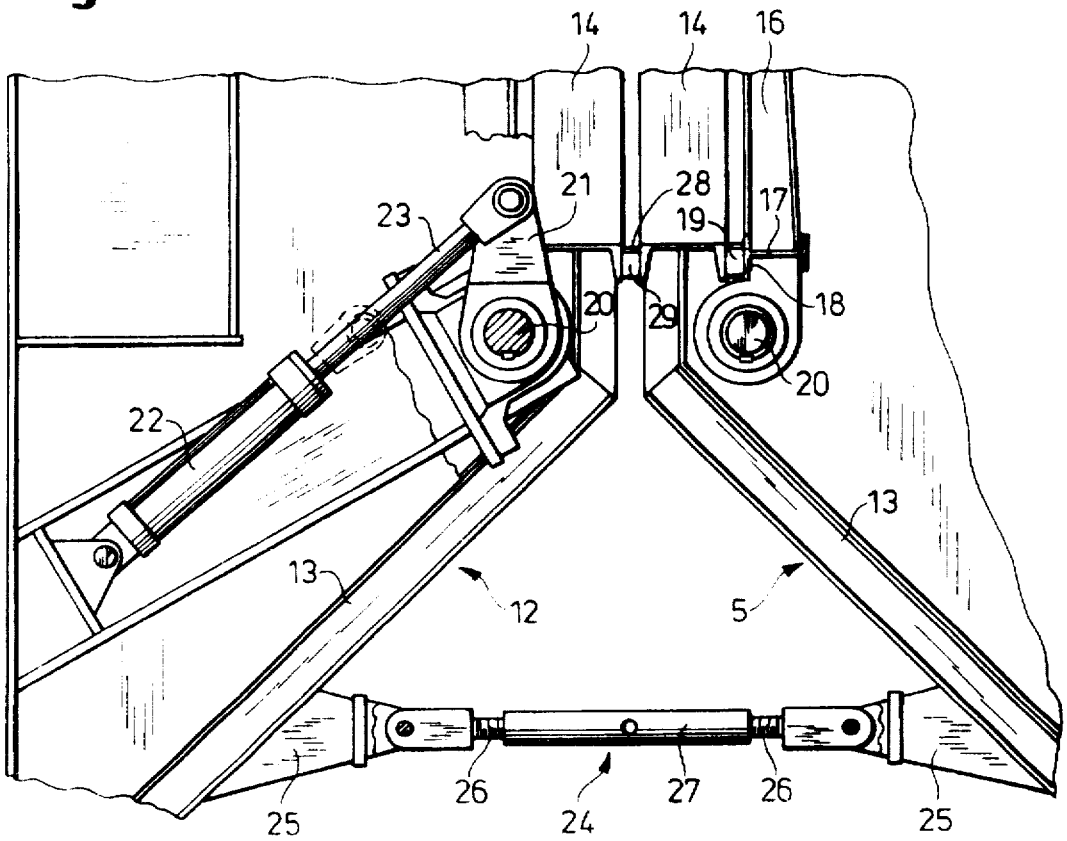
Figure 5:
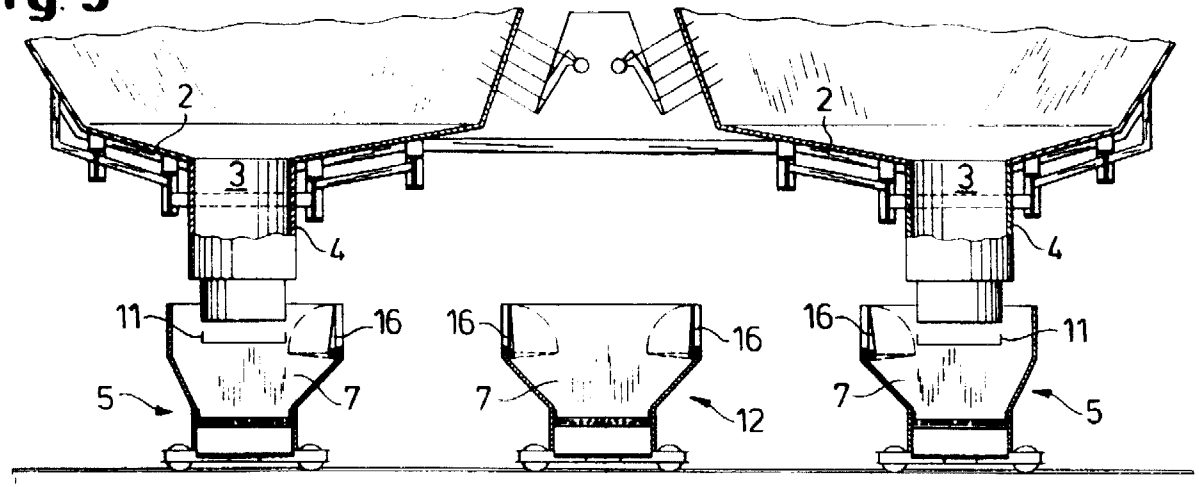
Figure 6:
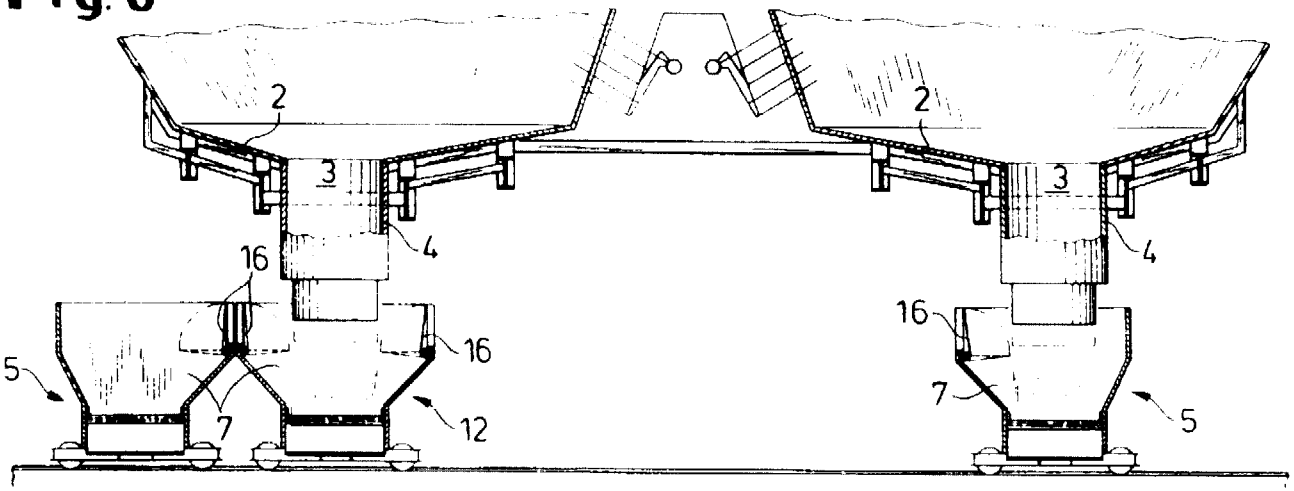

Several exemplary embodiments of the invention are shown in the drawing and are further described in the following. It shows:

FIG. 1 the lower part of a boiler with a wet ash remover,

FIG. 2 the side view of a wet ash remover,

FIG. 3 the region of connection between two mutually coupled wet ash removers,

FIG. 4 the detail Z according to FIG. 3 and in longitudinal section,

FIGS. 5 and 6 two ash funnels which are positioned side by side with wet ash removers in different operating positions.

The lower part of the fire chamber 1 of a boiler is illustrated which is constructed as an ash funnel 2. The ash funnel 2 has in the bottom thereof an opening 3 to which a dip member 4 is connected. Coal is combusted in the fire chamber 1 whereby the firing is preferably a molten ash firing, so that the ash is produced in molten form. The firing can also be a solid ash firing. The ash falls from the ash funnel 2 into the wet ash remover 5 which is positioned below the ash funnel 2.

The wet ash remover 5 consists of a movable trough 7 which is provided with a travelling gear 6 and in which a conveyor circulates. The conveyer is a drag chain conveyor, the chains 9 of which are provided with drag bars 8 and are guided within the trough 7 around rollers 10. This drag chain conveyor transports the ash out of the trough 7. The trough 7 is filled with water for the cooling of the ash. In order to ensure sealing of the firing chamber to ambient, the water level in the trough 7 remains sufficiently high so that the dip member 4 always maintains immersed in the water during operation of the boiler. The maximum depth of immersion of the dip member 4 when the boiler is hot is shown in FIG. 1 by way of the thin line 11.

The components of the drag chain conveyor are subjected to increased wear due to contact with the ash. As a result, the wet ash remover 5 must be taken out of operation to conduct repairs. To this end, a reserve ash remover 12 is provided which can be exchanged for the wet ash remover 5 in operation. In order to enable the exchange of the wet ash remover 5 without interruption of the burner operation, the wet ash remover 5 and the reserve ash remover 12 are symmetrically constructed. An opening 14 is provided in a side wall 13 of the wet ash remover 5 which extends from the upper edge thereof. The width of the opening 14 corresponds at least to the width of that side of the dip member 4 which lies in direction of travel of the wet ash remover 5. The height of the opening 14 depends on the maximum immersion depth of the dip member 4 as measured from the upper edge of the side wall 13 of the trough 7.

Over part of its length, the side wall 13 extends outwardly whereby the opening 14 forms the forward limit of this outwardly protruding portion 14. The opening 14 is closable by way of a gate 16 which can be swivelled from within the trough 7 against a frame 17 surrounding the opening 14. A sealing flange 18 is provided on the frame 17 which supports a compressible seal 19. In the closed condition, the gate 16 rests against this seal 19. The gate 16 can be made of one or more parts. Several gates 16 positioned side by side can be used instead of a single gate 16.

At the lower edge, the gate 16 is rigidly affixed to a shaft 20 which at its ends and outside the outwardly protruding portion 15 is rotatably supported on the outside of the side wall 13 of the trough 7 and is sealed, for example, by way of a stuffing box seal. A lever 21 is rigidly affixed to the shaft 20 at both sides of the gate 16. By way of these levers 21, the gate 16 can be swivelled from the vertical position to the horizontal position or vice versa. The levers 21 can be manually operated. Preferably, the levers are connected with a hydraulic drive. This hydraulic drive consists of a cylinder 22 which is rotatably affixed to the side wall 13 of the trough 7. The piston rod 23 extending from the cylinder 22 is rotatably affixed to the free end of the lever 21. The lever 21 can also be replaced by a toothed section rigidly affixed to the shaft 20 which engages a gear driven by an electric motor.

The reserve ash remover 12 is constructed in the same manner as the above-described wet ash remover 5. The reserve ash remover 12 is positioned below the boiler in reserve position in such a way that the openings 14 of the troughs 7 which are closed by the gate 16 are located in the opposing sides of the wet ash removers 5 and 12.

The wet ash remover 5 and the reserve ash remover 12 are on their opposing side walls 13 provided with coupling elements whereby the two wet ash removers 5, 12 can be temporarily connected with each other. The coupling elements can consist of a screwed connection including threaded bolts which penetrate the side walls 13 of the troughs 7 and are secured by nuts. Another coupling element is the turn buckle 24 illustrated in FIG. 4. This turn buckle 24 consists of two consoles 25 respectively affixed to a side wall 13 of the trough 7. A threaded bar 26 is rotatably affixed to each console 25. A threaded bushing 27 engages the two threaded bars 26. Upon rotation of the threaded bushing 27, the two wet ash removers 5, 12 are pulled toward each other. A further sealing flange 28 is provided on the outside of the frame 17 surrounding the opening 14, in which flange an outer seal 29 is inserted. Rotation of the threaded bushing 27 of the turn buckle 24 which functions as the coupling element moves the wet ash remover 5 and the reserve ash remover 12 so closely together that a liquid-tight connection of the wet ash removers 5, 12 is achieved by way of the outer seal 29.

The boiler illustrated in FIG. 5 is provided with two ash funnels 2 under which a wet ash remover 5 is respectively positioned. A reserve ash remover 12 is provided between these two wet ash removers 5 and on both sides has an opening 14 which is closable by a gate 16. Because of this construction, the reserve ash remover 12 can be exchanged as required for the right or left wet ash remover 5 shown in the drawing. In order to exchange a wet ash remover 5 in operation for a reserve ash remover 12 without interruption of the boiler operation, the reserve ash remover 12 which is filled with water is moved beside the wet ash remover 5 and coupled thereto. After coupling, for example, by way of the turn buckle 24, the wet ash remover 5 and the reserve ash remover 12 are connected liquid-tight by way of outer seal 29. Thereafter, the gates 16 in the adjacent side walls 13 are swivelled into the horizontal position so that a common water-filled interior is created in the wet ash remover 5 and the reserve ash remover 12 by way of the openings 14. In this condition, the wet ash remover 5 is moved from of the region of the ash funnel 2 until the reserve ash remover 12 is positioned below the ash funnel 2 and the dip member 4 is immersed in the trough 7 of the reserve ash remover 12. This operating condition is shown in FIG. 6. Since the reserve ash remover 12 is now in operating condition, the gates 16 are swivelled back into the vertical position and the openings 14 closed thereby. The wet ash remover 5 is decoupled from the reserve ash remover 12 and the water is drained from the wet ash remover 5. Repairs on the wet ash remover 5 can now be carried out. The process of placing the wet ash remover 5 back in operation is carried out in reverse order.

The embodiments of the invention in which an exclusive property or privilege is claimed are defined as follows:

1. A wet ash remover installation comprising: a first wet ash remover; a boiler with an ash funnel, said first wet ash remover being placed in an operating position below said ash funnel; a second movable wet ash remover similar to said first wet ash remover and placed in a reserve position; said first and second wet ash removers respectively comprising a water-filled trough with side walls housing a conveying appliance; a dip member connected with said ash funnel immersed into said trough; each said trough having an opening at the same height in one of said side walls, said opening extending to a top edge of said one of said side walls and having a width corresponding to the width of said dip member and having a height corresponding at least to a maximum immersion depth of said dip member in the wet ash remover; a compressible seal surrounding each said opening and received in a frame and closeble by a movable wall portion; said movable wall portion being a rotatable gate engaging said opening from the inside; opposing side walls of the respective wet ash removers, the openings being positioned in said opposing side walls; said wet ash removers having coupling elements.

2. A wet ash remover installation according to claim 1, including two laterally spaced-apart wet ash removers respectively placed in operating position under spaced-apart ash funnels; a common wet ash remover in reserve position between said spaced-apart ash funnels; rotatable gates respectively in mutually opposite side walls with respect to said common wet ash remover for closing said openings.

3. A wet ash remover installation according to claim 1, wherein said opening is located in a laterally outwardly protruding portion of the side wall.

4. A wet ash remover installation according to claim 1, including a shaft guided through a protruding portion of the sidewall and supported on the outside of the side wall at a lower edge of said gate; and a positioning arrangement connected to said shaft.

5. A wet ash remover installation according to claim 1, wherein said frame surrounding the opening in each of said wet ash removers has a compressible seal on the outside.

6. A wet ash remover installation according to claim 1, wherein said coupling elements of said wet ash removers comprise a screwed connection extending through each frame.

7. A wet ash remover installation according to claim 1, wherein said coupling elements comprise a turn buckle affixed to said opposing side walls of the respective wet ash removers.

* * * * *